US005868514A

United States Patent [19]

Gibson

[11] Patent Number: 5,868,514

[45] **Date of Patent: *Feb. 9, 1999**

[54] SMALL WATER VEHICLE LIFT

[76] Inventor: Randolph P. Gibson, 2668 Waxwood Ct., Clearwater, Fla. 34621

[ * ] Notice: The term of this patent shall not extend beyond the expiration date of Pat. No. 5,628,583.

[21] Appl. No.: 831,723

[22] Filed: Apr. 1, 1997

Related U.S. Application Data

[63] Continuation of Ser. No. 507,705, Jul. 26, 1995, Pat. No. 5,628,583.

[51] Int. Cl.[6] ..... B63C 1/00

[52] U.S. Cl. ..... 403/3; 114/48

[58] Field of Search ..... 405/3, 4, 218, 405/219, 221; 114/44, 48

[56] References Cited

U.S. PATENT DOCUMENTS

| | | | |
|---|---|---|---|
| 4,832,210 | 5/1989 | Wood, II | 405/3 X |
| 5,140,923 | 8/1992 | Wood | 114/48 |
| 5,427,471 | 6/1995 | Godbersen | 405/3 |
| 5,628,583 | 5/1997 | Gibson | 405/3 |

*Primary Examiner*—William P. Neuder
*Attorney, Agent, or Firm*—William E. Noonan

[57] ABSTRACT

A water vehicle lift includes a winch which is operable to extend and retract an elongated flexible cable to lower and raise a platform on which a small water vehicle may rest. The winch is preferably mounted on a piling with the platform moving up and down adjacent the piling. On the face of the platform immediately adjacent the piling, a wheel is provided which rolls on the surface of the piling to maintain the platform slightly spaced away from the piling.

13 Claims, 5 Drawing Sheets

SMALL WATER VEHICLE LIFT

RELATED APPLICATION

This is a continuation of U.S. patent application Ser. No. 08/507,705, filed Jul. 26, 1995, now U.S. Pat. No. 5,628, 583.

BACKGROUND OF THE INVENTION

The present invention relates to a small water vehicle lift. In the prior art, water vehicle lifting devices are well known. However, Applicant is unaware of any such device including all of the features and aspects of the present invention.

The following prior art is known to Applicant:

U.S. Pat. No. 4,432,664 to Baldyga discloses a boat hoist including a piston and cylinder unit located within the support column. Roller bearings are provided within the support column and engage the inner surfaces thereof as the hoist lifts and lowers a boat. The present invention differs from the teachings of Baldyga by contemplating the use of a winch located on the top of a piling. The winch employs a flexible cable to lift and lower a platform and wherein a wheel attached to the platform rolls on the outer surface of the piling.

U.S. Pat. No. 4,678,366 to Williamson discloses a boat lift including an H-beam driven into the sea bed and supporting a housing reciprocating with respect to the H-beam, the housing having rollers which roll on inner surfaces of the H-beam. The present invention differs from the teachings of Williamson as contemplating a boat lift including a winch mechanism mounted on the top of a piling, and with a flexible cable interconnected between the winch and a boat supporting platform and wherein the platform has a wheel engaging an outer surface of the piling while the platform is being reciprocated.

U.S. Pat. No. 4,983,067 to Montgomery discloses a boat lift apparatus which allows horizontal as well as vertical movement of the load. The present invention differs from the teachings of Montgomery as contemplating a boat lift allowing vertical reciprocation only and includes a guide wheel attached to the lifting platform which rolls along the outer surface of the support piling for the boat lift to guide the platform in its lifting and lowering movements.

U.S. Pat. No. 5,245,940 to Rockwood discloses a load lifting device designed to be used to lift and lower small watercraft including a winch designed to extend or retract a cable to allow for lowering or hoisting of the small watercraft. When the watercraft is lifted to its uppermost position, the extension post of the device may be rotated to swing the watercraft over the adjacent land. Rollers are provided which roll on outer surfaces of the polygonal cross-section support post to perform a guiding function. The present invention differs from the teachings of Rockwood as contemplating a support piling of generally circular cross-section and a single roller mounted on a rear portion of the support platform for the watercraft and which rolls on the outer surface of the piling to guide the platform in its lifting and lowering movements.

U.S. Pat. No. 5,311,970 to Basta discloses a low profile watercraft lift with a manually operated winch which operates a take-up drum for a cable attached to the lifting platform. A platform carrier is slidably received within a column. The present invention differs from the teachings of Basta as contemplating a support platform having a wheel facing the support piling for the apparatus, which wheel rolls on the outer surface of the piling to guide the platform.

U.S. Pat. No. 5,378,082 to Hiller et al. discloses a ship lifting installation which includes motor operated cable winding drums. The present invention differs from the teachings of Hiller et al. as contemplating a small water vehicle lift supported on a piling and wherein the lifting platform has a wheel which rolls on the outer surface of the piling when the platform is being lifted and lowered.

SUMMARY OF THE INVENTION

The present invention relates to a small water vehicle lift. The present invention includes the following interrelated objects, aspects and features:

(A) In a first aspect, the inventive small water vehicle lift is intended to be mounted on a support structure such as a piling of generally circular cross-section. Customarily, the piling is driven into the bed of the body of water with which the inventive lift is associated. In the preferred embodiment, the top of the piling is provided with a flat surface for supporting a standard winch mechanism, the details of which do not form a part of the present invention. If desired, the winch mechanism may include an on-off switch which may be activated through a wireless electronic remote control. For this purpose, an antenna may be mounted on the winch housing and may be interconnected with the switch.

(B) An elongated guide tube is preferably fastened on the piling with the guide tube extending vertically and parallel with the piling. The winch includes a guide pulley guiding a cable which extends from the winch, over the pulley and into the elongated guide tube and downwardly extending therethrough. The cable is fastened at its end distal from the winch to a fitting fastened to a lift platform.

(C) The lift platform preferably includes a frame of generally rectangular configuration having reinforcing support beams supporting cross members which may comprise pieces of wood such as, for example, 4×4s. If desired, the 4×4s may be covered with a cushioning material such as, for example, carpet.

(D) The above-mentioned fitting, in the preferred embodiment, includes an upstanding conduit having a plastic sleeve extending therethrough and which carries an internal pipe, with the conduit, sleeve and pipe being constrained to move together through the use of a fastener extending therethrough. The fastener may also retain the distal end of the cable. When the winch is operated to unwind or wind the cable and thereby reciprocate the platform, the pipe slides within a sleeve contained within the elongated guide tube so that the lift platform may suitably reciprocate.

(E) On the lift platform, below the fitting, a mount is provided on which is mounted a rotatable wheel. The wheel engages the outer surface of the piling and, when the winch is operated to reciprocate the lift platform, the wheel rolls on the outer surface of the piling so that, along with the guidance of the pipe within the elongated guide tube, the wheel guides the lift platform immediately adjacent the piling while maintaining spacing therefrom to prevent binding of the lift platform on the piling.

Accordingly, it is a first object of the present invention to provide a small water vehicle lift.

It is a further object of the present invention to provide such a device including a winch mechanism mounted on top of a support piling and a guide tube extending parallel with the piling and fastened thereto.

It is a still further object of the present invention to provide such a device including a lift platform having a guide wheel designed to roll along the outer surface of the piling.

It is a still further object of the present invention to provide such a device including a pipe attached to the lift platform and guidingly received within the elongated guide tube thereof.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
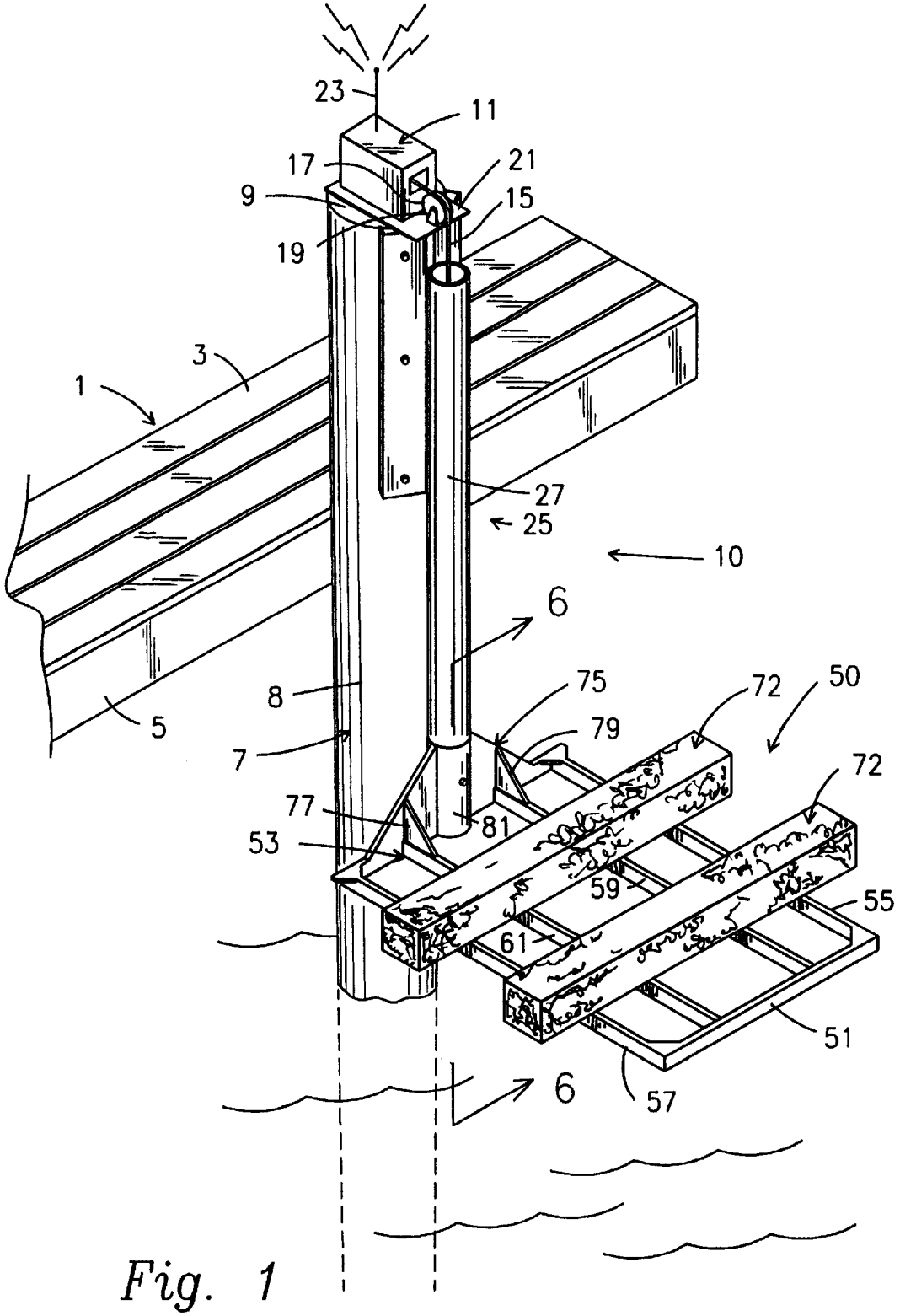
FIG. 1 shows a perspective view of the present invention.
Figure 2:
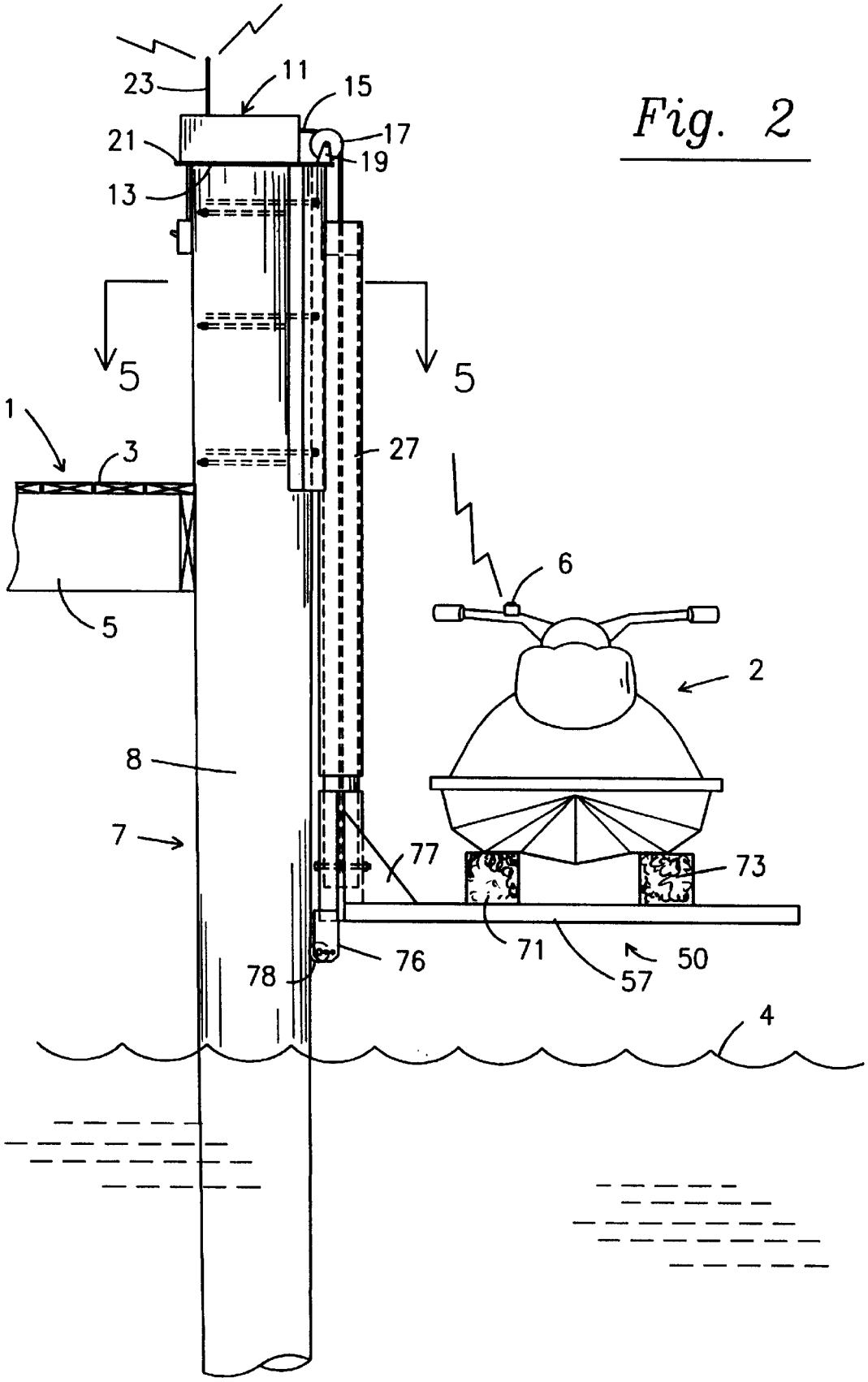
FIG. 2 shows a front elevational view of the invention with portions thereof shown in phantom and with the lift platform in a raised position.
Figure 3:
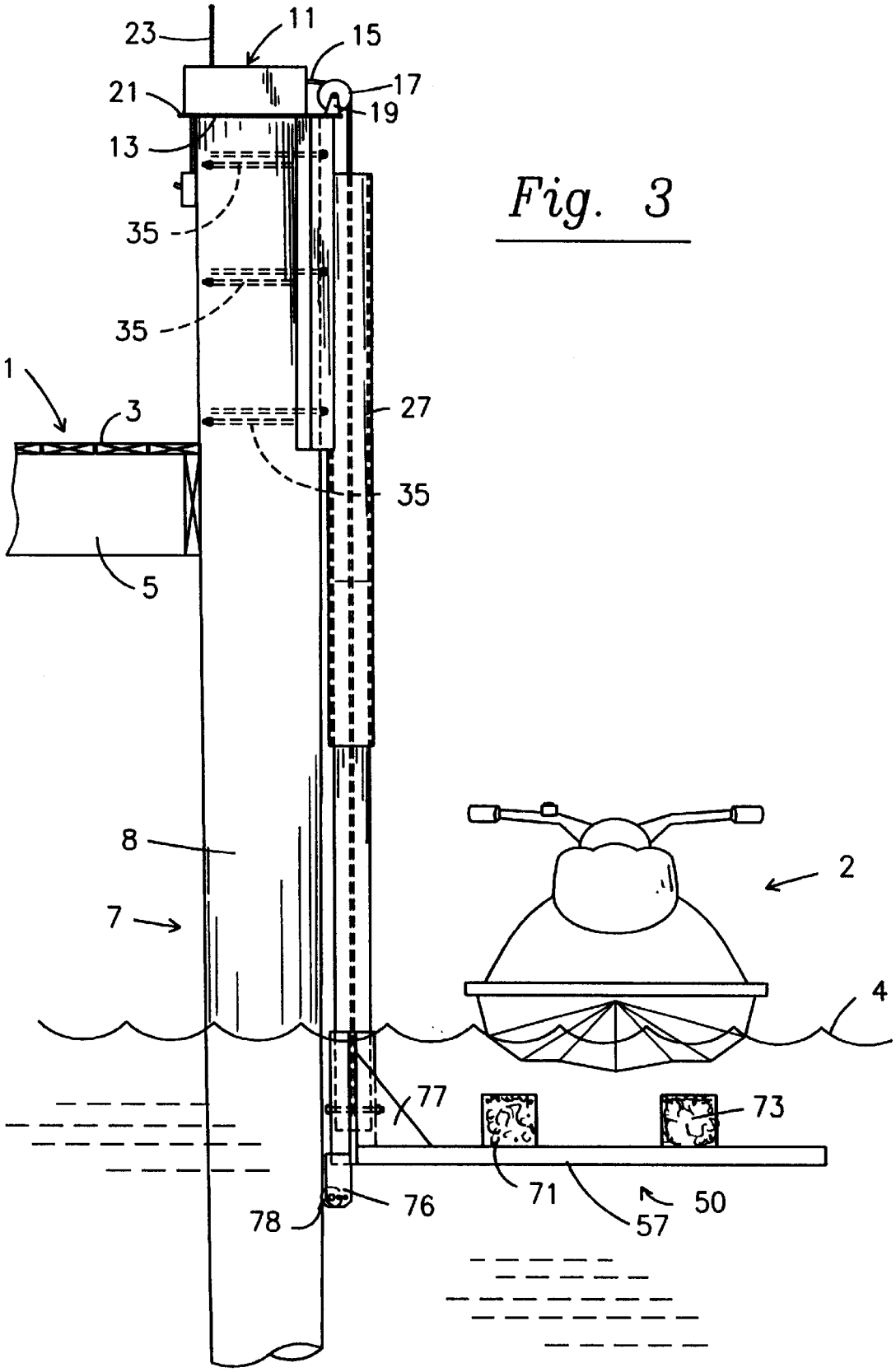
FIG. 3 shows a front elevational view similar to that of FIG. 2 but with the lift platform in a lowered position.

With particular reference to FIGS. 1, 2 and 3, a dock 1 includes decking 3 and a side wall 5. The dock 1 which usually comprises a pier is supported by a vertically disposed support structure such as piling 7 having a generally circular or elliptical cross-section (FIG. 4) and having an outer surface 8 as well as a flattened top surface 9. The piling could be a concrete rectangular, round or square structure imbedded in the seabed.

The present invention is generally designated by the reference numeral 10 and is seen to include a winch or winch mechanism 11 having a flat undersurface 13 which is provided to allow the winch 11 to sit on the flat top 9 of the piling 7 and to be fastened thereon by any suitable means (not shown). The winch mechanism 11 may be of any suitable and customary design including, for example, an electric motor drivingly connected to a rotary drum carrying a length of cable 15 guided over a pulley 17 mounted to a mount 19 fastened to a support 21 resting on the flat top of the piling 7. The winch mechanism could be attached to any top portion of a piling or adjacent upright dock structure.

If desired, the winch 11 may have an internal on-off switch which is activated by a remote wireless control 6 or it can be directly activated by switch 90. If the former is the case, the winch 11 is provided with an antenna 23 allowing the winch 11 to receive electromagnetic or acoustic waves which control activation and deactivation of the winch motor.

Figure 5:
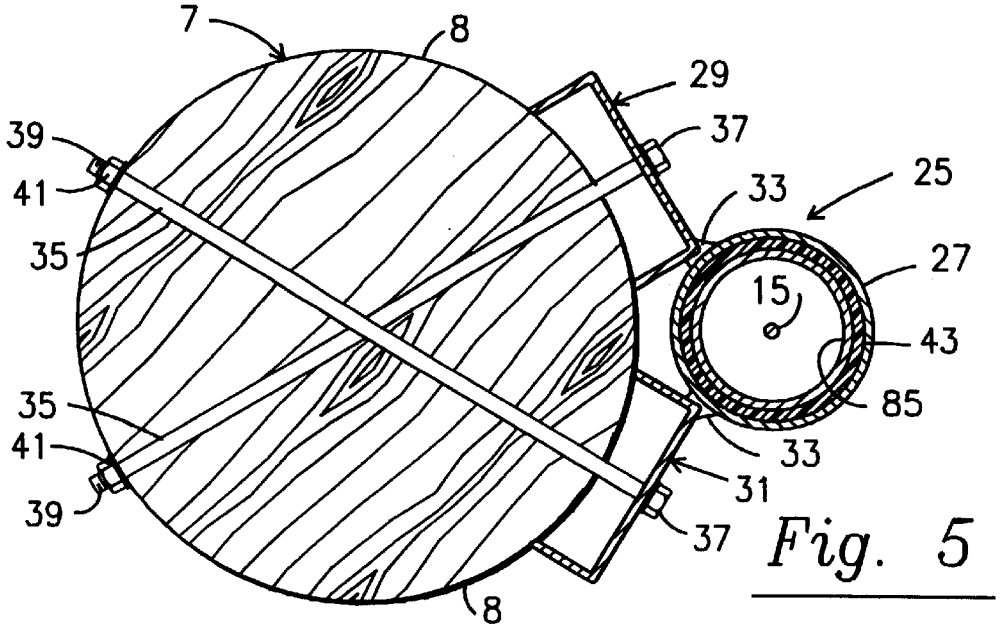
FIG. 5 shows a cross-sectional view along the line 5—5 of FIG. 2.

With particular reference to FIGS. 1 and 5, first guide means includes a guide member 25 including a tube 27 to which are fastened two elongated brackets 29 and 31, via any suitable means such as, for example, the weld beads 33 (FIG. 5). As shown in FIG. 5, the brackets 29 and 31 are three-sided and defined, along with the surface 8 of the piling 7, hollow internal chambers. The brackets 29 and 31 are fastened to the piling 8 through the use of elongated bolts 35, each of which has an enlarged proximal head 37 and a threaded distal end 39. A threaded nut 41 is threadably received over each threaded end 39 of each respective bolt 35 to fasten the bolts 35 and, thus, the brackets 29 and 31 and, thus, the elongated guide member 25 onto the piling 7.

As particularly seen in FIGS. 5 and 6, the tube 27 has an inner lining 43 which is provided for a purpose to be described in greater detail hereinafter.

Figure 4:
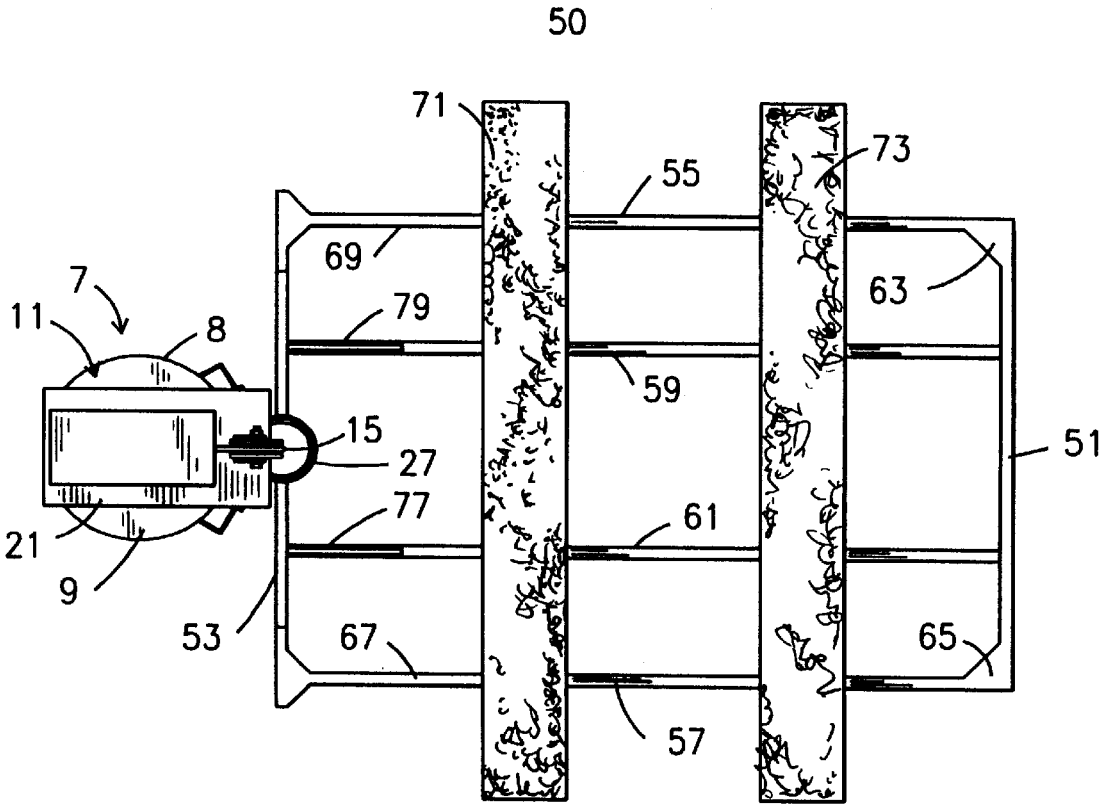
FIG. 4 shows a top view of the present invention.
Figure 6:
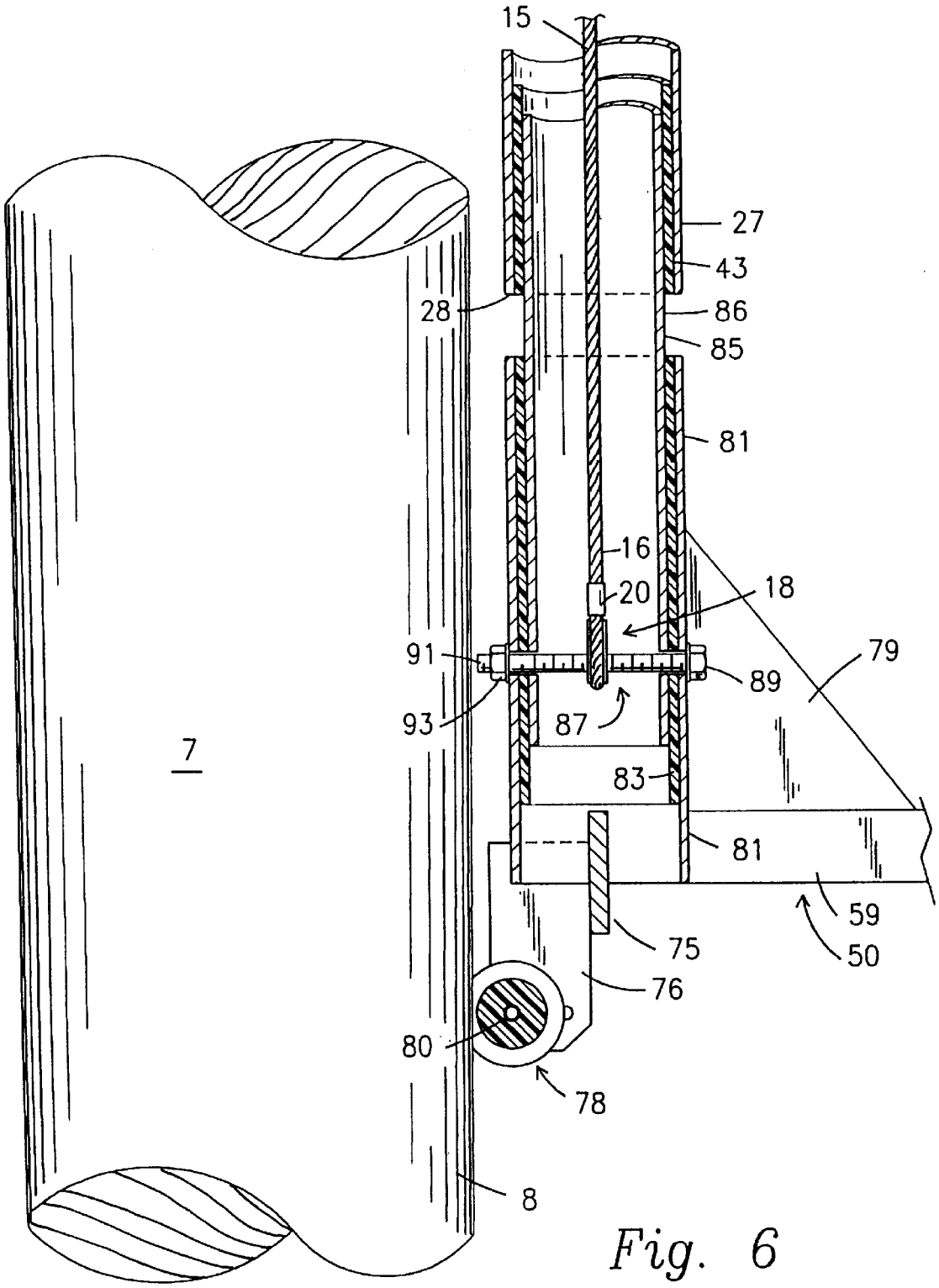
FIG. 6 shows a sectional view along the line 6—6 of FIG. 1.

With particular reference to FIGS. 1, 4 and 6, the lift platform 50 has a generally rectangular configuration including end beams 51 and 53, side beams 55 and 57 and central beams 59 and 61 which are parallel to the side beams 55 and 57. The corners 63, 65, 67 and 69 of the platform 50 are suitably reinforced as particularly shown in FIG. 4. Cross members 71 and 73 are fastened over the beams 55, 59, 61 and 57 and run generally perpendicular thereto and generally parallel to the end beams 51 and 53. The cross members 71 and 73 may be suitably covered with a padded material such as, for example, carpet. In the preferred embodiment of the present invention, the cross members 71 and 73 are each made of wood 4×4s.

As best seen with reference to FIGS. 1 and 6, the end beam 53 has, integrally formed therewith, a fitting 75 which has a generally triangular configuration as well as two cross braces 77 and 79 (FIG. 1) which are respectively fastened to the beams 61 and 59. The fitting 75 includes a conduit 81 having an inner lining 83 (FIG. 6) preferably made of a material such as, for example, ultra-high molecular weight polyethylene. A pipe 85 is received within the lining 83, as best seen in FIG. 6, and, as also seen in FIG. 6, the conduit 81, lining 83 and pipe 85 are suitably fastened together through the use of a bolt 87 having an enlarged head 89, a threaded distal end 91 and a locking nut 93 fastening the bolt 87 as shown in FIG. 6. As best seen in FIG. 6, the bolt 87 extends through openings in the conduit 81, lining 83 and pipe 85. The distal end 16 of the cable 15 includes a loop 18 which is created through the use of the fastener 20 to provide an opening (not shown) through which the bolt 87 extends as best seen in FIG. 6.

In the preferred embodiment of the present invention, the bearing sleeve 43 of the tube 27 is made of ultra-high molecular weight polyethylene, the same material from which the lining 83 of the conduit 81 is made.

The pipe 85 has an outer surface 86 which is slidably and bearingly received within the inner surfaces of the lining 43 of the tube 27. The first guide means includes the outer surfaces 86 of the pipe 85 sliding along the inner surfaces of the lining 43 as the pipe is reciprocated up or down through actions of the winch 11.

With particular reference to FIG. 6, it is seen that the fitting 75 has fastened thereto second guide means comprising a mount 76 to which is rotatably mounted a wheel 78 having an axle 80 which is received by the mount 76 to allow the wheel 78 to freely rotate. As seen in FIG. 6, the outer surfaces of the wheel 78 engage the outer surfaces 8 of the piling 7. The wheel 78 rolls on the surfaces 8 of the piling 7 as the platform 50 is reciprocated up and down through action of the winch 11. The wheel 78 provides guidance along with the guidance provided by the elongated guide member 25 to maintain linear reciprocation in the vertical direction of the lift platform 50.

As best seen with reference to FIG. 6, the lower termination of the tube 27 is defined by a surface 28 which may be engaged by an upper surface 82 of the conduit 81 when the winch 11 is operated to reciprocate the lift platform 50 upwardly to limit the extent of upward movement of the lift platform 50.

With reference to FIG. 3, it is seen that a watercraft 2 may be floated into position overlying the cross members 71 and 73 with the lift platform 50 in its lowered position beneath the level 4 of the associated body of water. With reference to FIG. 2, the lift platform 50 may be raised through operation of the winch 11 to engage the underside of the watercraft 2 and lift it out of the water to a position of storage as shown in FIG. 2. When the lift platform 50 is reciprocated from the position shown in FIG. 3 to the position shown in FIG. 2, the wheel 78 rolls along the surface 8 of the piling 7 to assist in guiding the platform 50 therealong while maintaining spacing therefrom. The guidance provided by the wheel 78 engaging the surface 8 of the piling 7 is in conjunction with the guidance provided by the sliding of the pipe 85 within the lining 43 of the tube 27.

In the preferred embodiment of the present invention, the tube 27 is made of a suitable metallic material such as, for example, aluminum. As explained above, the lining 43 is preferably made of a material such as ultra-high molecular weight polyethylene. The pipe 85 is preferably made of a material such as stainless steel with the outer surface 86 thereof being slidably received within the ultra-high molecular weight polyethylene lining 43 of the tube 27.

An advantage of this vehicle lift is that it generally is positioned above the water and merely dips the platform into the water to retrieve the vessel.

As such, an invention has been disclosed in terms of a preferred embodiment thereof which fulfills each and every one of the objects of the present invention as set forth hereinabove and provides a new and useful small water vehicle lift of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. In combination with a vertically disposed support structure, a water vehicle lift comprising:

a) a lift platform having a horizontally disposed support surface for supporting a water vehicle;

b) an elongated first guide means fixed to said vertically disposed support structure above a surface of the water;

c) second guide means fixed to said lift platform and engaging said vertically disposed support structure;

d) slidable means attached to said lift platform for engaging said first guide means; and e) means mounted to said support structure and attached to said slidable means for selectively moving said slidable means in a vertical direction relative to said first guide means, whereby said platform is guidingly moved in a vertical direction adjacent said vertically disposed support structure.

2. The lift of claim 1, wherein said first guide means comprises an elongated guide tube fastened to the vertically disposed support structure and said slidable means comprises a pipe fixed to said lift platform slidably received within said elongated guide tube.

3. The lift of claim 2, wherein a bearing sleeve is fastened to one of said tube or pipe and slidably bears against the other of said tube or pipe.

4. The lift of claim 3, wherein said bearing sleeve is fastened to said tube.

5. The lift of claim 1, wherein said second guide means comprises a rotatable wheel fastened to said lift platform and rolling on outer surfaces of the vertically disposed support structure.

6. The lift of claim 4, wherein said bearing sleeve is made of high molecular weight polyethylene.

7. The lift of claim 2, wherein said tube is made of aluminum.

8. The lift of claim 2, wherein a bracket is attached to said tube, and further including a plurality of elongated bolts fastening said bracket to said piling.

9. The lift of claim 1, wherein a top surface of the top portion of said vertically disposed support structure is flat.

10. The lift of claim 2, wherein said pipe is made of stainless steel.

11. The lift of claim 1, wherein said horizontally disposed support surface comprises a plurality of wood beams.

12. The lift of claim 11, wherein each wood beam comprises a 4×4.

13. The lift of claim 1, wherein said vertically disposed support structure is a piling having a generally circular or elliptical cross-section.

* * * * *